US008366256B2

(12) United States Patent
Jones et al.

(10) Patent No.: US 8,366,256 B2
(45) **Date of Patent: *Feb. 5, 2013**

(54) SOLID INK STICK WITH INTERFACE ELEMENT

(75) Inventors: Brent Rodney Jones, Sherwood, OR (US); Darrell Ray Finneman, Albany, OR (US); Brian Walter Aznoe, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 300 days.

This patent is subject to a terminal disclaimer.

(21) Appl. No.: 12/908,071

(22) Filed: Oct. 20, 2010

(65) Prior Publication Data

US 2011/0032318 A1 Feb. 10, 2011

Related U.S. Application Data

(62) Division of application No. 11/473,632, filed on Jun. 23, 2006, now Pat. No. 7,857,439.

(51) Int. Cl.
*B41J 2/175* (2006.01)

(52) U.S. Cl. ..... 347/88

(58) Field of Classification Search ..... 347/19, 347/88, 99

See application file for complete search history.

(56) References Cited

U.S. PATENT DOCUMENTS

| | | | | |
|---|---|---|---|---|
| 5,223,860 | A | 6/1993 | Loofbourow et al. | |
| 5,442,387 | A | 8/1995 | Loofbourow et al. | |
| 5,734,402 | A | 3/1998 | Rousseau et al. | |
| 5,861,903 | A | 1/1999 | Crawford et al. | |
| 5,975,688 | A | 11/1999 | Kanaya et al. | |
| 6,056,394 | A | 5/2000 | Rousseau et al. | |
| 6,213,600 | B1 | 4/2001 | Kobayashi et al. | |
| 6,247,805 | B1 | 6/2001 | Iwaya | |
| 6,317,149 | B1 | 11/2001 | Mochida et al. | |
| 6,565,200 | B1 | 5/2003 | Jones | |
| 6,648,435 | B1 | 11/2003 | Jones | |
| 6,672,716 | B2 | 1/2004 | Jones | |
| 6,761,443 | B2 | 7/2004 | Jones | |
| 6,820,815 | B2 | 11/2004 | Meunier et al. | |
| 6,840,613 | B2 | 1/2005 | Jones | |
| 6,924,835 | B1 | 8/2005 | Silverbrook et al. | |
| 7,296,882 | B2 * | 11/2007 | Buehler et al. | 347/88 |
| 7,517,072 | B2 * | 4/2009 | Jones et al. | 347/88 |
| 7,857,439 | B2 * | 12/2010 | Jones et al. | 347/88 |
| 2003/0038851 | A1 | 2/2003 | Oriol | |

FOREIGN PATENT DOCUMENTS

| | | | |
|---|---|---|---|
| EP | 1359014 | A1 | 11/2003 |
| EP | 1359015 | A1 | 11/2003 |
| EP | 1359024 | A1 | 11/2003 |
| EP | 1731315 | A1 | 12/2006 |

OTHER PUBLICATIONS

Non-Final Office Action for U.S. Appl. No. 11/473,610, Mailed Mar. 24, 2009, United States Patent and Trademark Office (6 pages).

Amendment in Response to Non-Final Office Action for U.S. Appl. No. 11/473,610, submitted Apr. 17, 2009 (11 pages).

(Continued)

*Primary Examiner* — Anh T. N. Vo

(74) *Attorney, Agent, or Firm* — Maginot, Moore & Beck, LLP

(57) ABSTRACT

An ink stick for use in a phase change ink imaging device has a protrusion with a predetermined height that is configured to enable a sensor in an ink loader of the imaging device to detect the height of the protrusion. The predetermined height of the protrusion corresponds to a control parameter for the imaging device.

10 Claims, 15 Drawing Sheets

OTHER PUBLICATIONS

Non-Final Office Action for U.S. Appl. No. 11/473,611, Mailed Oct. 16, 2008, United States Patent and Trademark Office (18 pages).
Amendment in Response to Non-Final Office Action for U.S. Appl. No. 11/473,611, submitted Jan. 15, 2009 (18 pages).
Non-Final Office Action for U.S. Appl. No. 11/982,914, Mailed Jul. 8, 2010, United States Patent and Trademark Office (13 pages).
Amendment in Response to Non-Final Office Action for U.S. Appl. No. 11/982,914, submitted Sep. 8, 2010 (12 pages).

* cited by examiner

FIG. 4
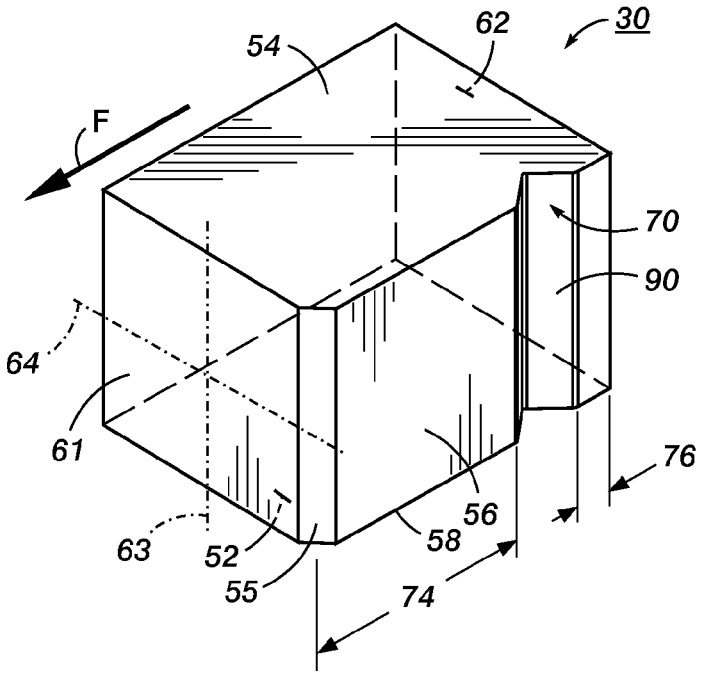
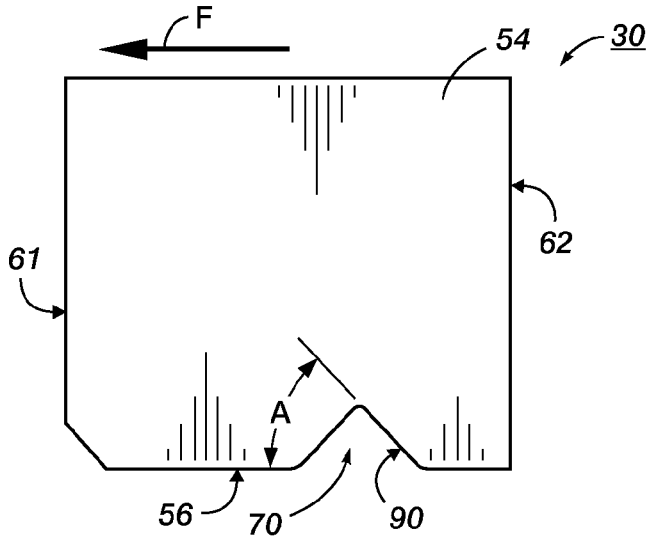
FIG. 5

FIG. 6
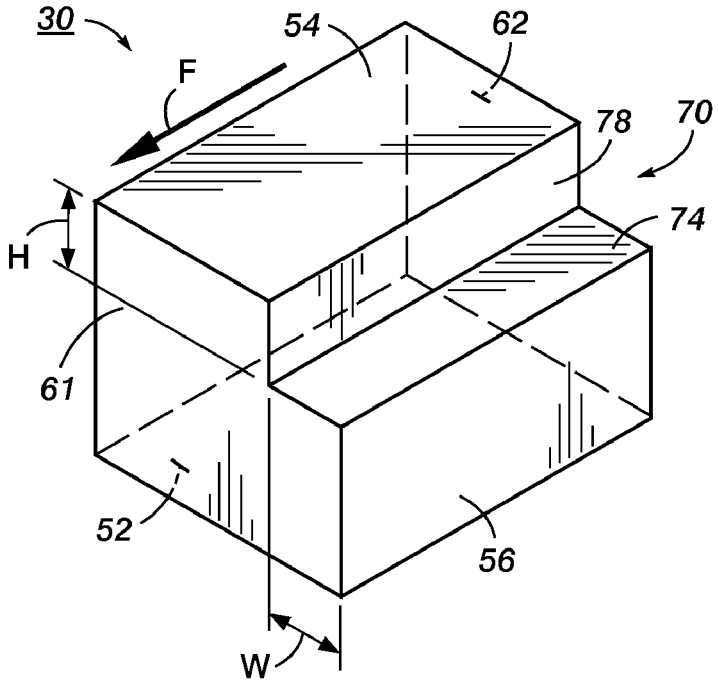
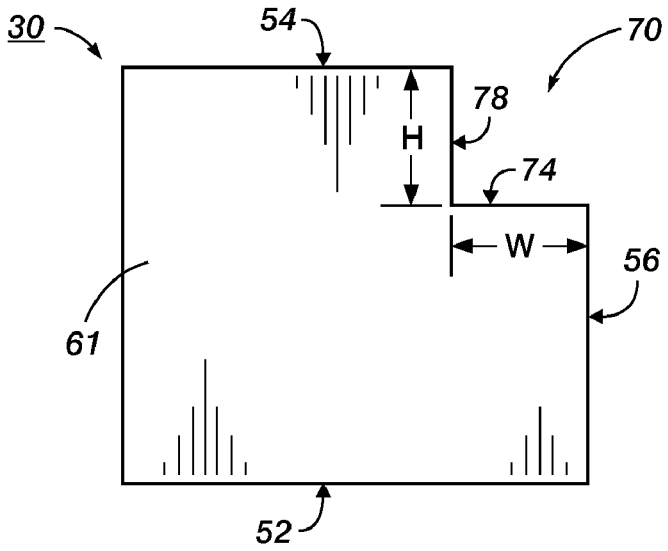
FIG. 7

FIG. 8
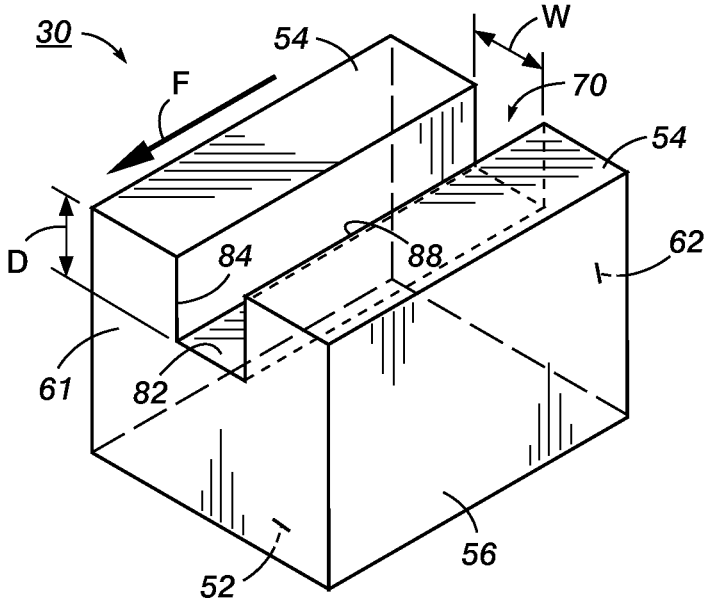
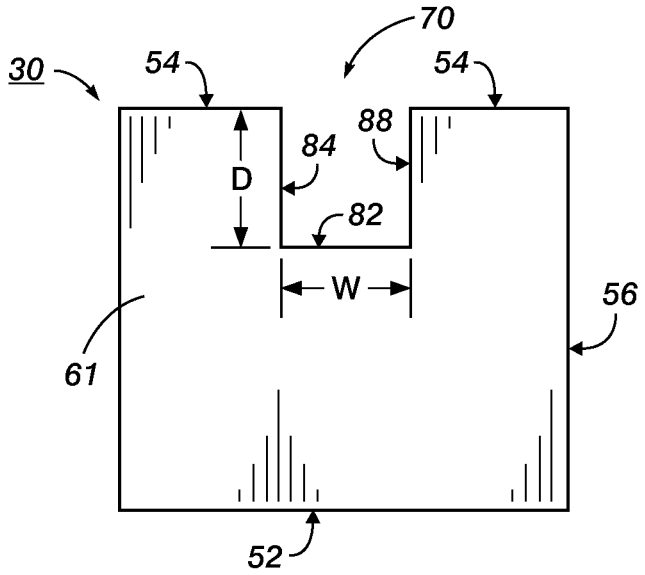
FIG. 9

FIG. 12
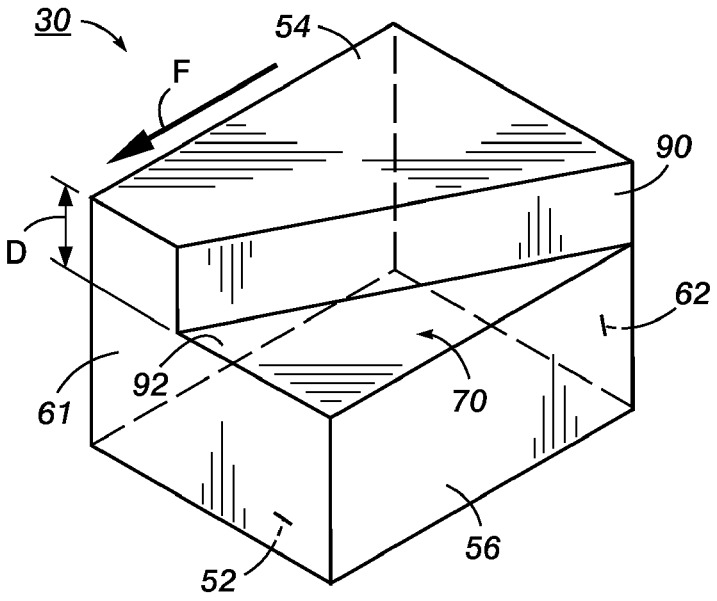
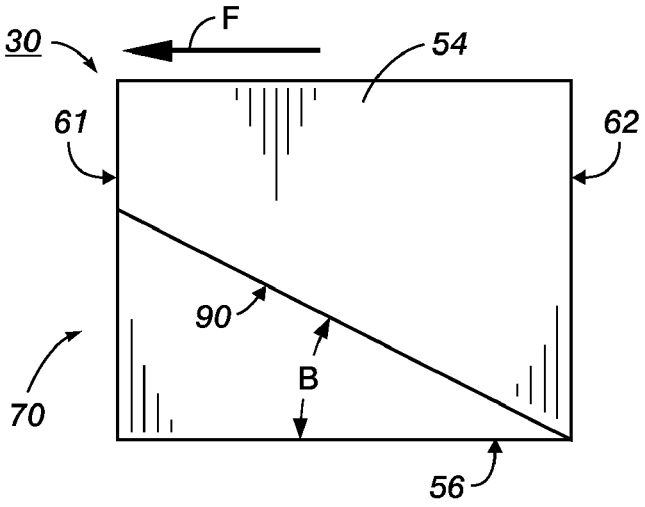
FIG. 13

FIG. 14
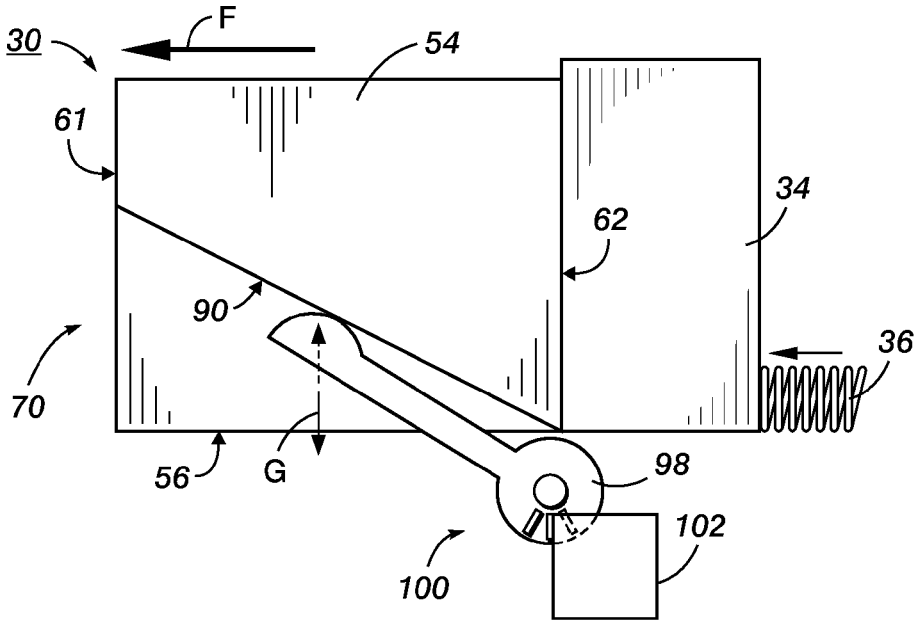
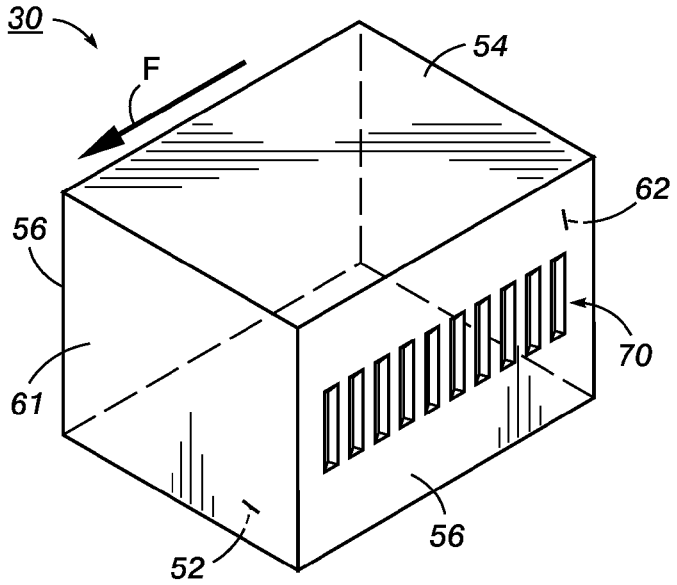
FIG. 15

| | PAGE PACK | COLOR | EUROPEAN COLOR | ASIAN COLOR | THERMAL SETTINGS |
|---|---|---|---|---|---|
| DIMENSION A | X | | | | |
| DIMENSION B | | | | | X |
| ANGLE ONE | | X | | | |
| ANGLE TWO | | | X | | |
| ANGLE THREE | | | | X | |

SOLID INK STICK WITH INTERFACE ELEMENT

CLAIM OF PRIORITY AND CROSS-REFERENCE TO RELATED APPLICATIONS

This application is a divisional of co-pending application Ser. No. 11/473,632, filed on Jun. 23, 2006. Reference is made to copending U.S. application Ser. No. 11/982,914, entitled "Solid Ink Stick With Transition Indicating Region" which was filed on Nov. 6, 2007. Reference is also made to commonly-assigned patent application Ser. No. 11/473,610, entitled "Ink Loader for Interfacing with Solid Ink Sticks" which issued as U.S. Pat. No. 7,553,008 on Jun. 30, 2009, Ser. No. 11/473,656, entitled "Solid Ink Stick with Coded Sensor Feature" which issued as U.S. Pat. No. 7,537,326 on May 26, 2009; and Ser. No. 11/473,611, entitled "Solid Ink Stick with Enhanced Differentiation" which issued as U.S. Pat. No. 7,517,072 on Apr. 14, 2009, all of which were filed concurrently with the parent application, the entire disclosures of which are expressly incorporated by reference herein.

TECHNICAL FIELD

This disclosure relates generally to phase change ink jet printers, the solid ink sticks used in such ink jet printers, and the load and feed apparatus for feeding the solid ink sticks within such ink jet printers.

BACKGROUND

Solid ink or phase change ink printers conventionally use ink in a solid form, either as pellets or as ink sticks of colored cyan, yellow, magenta and black ink fed into shape coded openings. These openings fed generally vertically into the heater assembly of the printer where they were melted into a liquid state for jetting onto the receiving medium. The pellets were fed generally vertically downwardly, using gravity feed, into the printer. These pellets were elongated and tapered on their ends with separate multisided shapes each corresponding to a particular color.

Solid ink sticks have been typically either gravity fed or spring loaded into a feed channel and pressed against a heater plate to melt the solid ink into its liquid form. These ink sticks were shape coded and of a generally small size. One system used an ink stick loading system that initially fed the ink sticks into a preload chamber and then loaded the sticks into a load chamber by the action of a transfer lever. Earlier solid or hot melt ink systems used a flexible web of hot melt ink that is incrementally unwound and advanced to a heater location or vibratory delivery of particulate hot melt ink to the melt chamber.

In prior art phase change ink jet printing systems, the interface between a control system for the phase change ink jet printer and the solid ink used in such printers has been limited. The control systems have had limited ability to gain information about the solid ink that is currently in the printer. For instance, prior art control systems are limited in their ability to determine the amount of ink ejected from the printhead of the printer. Once ink has been melted and reaches the print head of a printer, the liquid ink flows through manifolds to be ejected from microscopic orifices through use of piezoelectric transducer (PZT) print head technology. An electric pulse is applied to the PZT thereby causing droplets of ink to be ejected from the orifices. The duration and amplitude of the electrical pulse applied to the PZT is controlled so that a consistent volume of ink may be ejected by each orifice. Thus, the total amount of ink that has been "theoretically" used may be calculated by counting the number of times ink has been ejected from the PZT and multiplying that by the amount of ink that should have been ejected during each pulse. The amount of ink ejected from the PZT may vary or drift over time due to a number of factors, such as, for example, prolonged use. Prior art control systems are generally not able to determine the amount of drift of the ink ejected from the printhead.

As another example, prior art control systems are typically only able to sense when the first color (of the four colors) of solid ink in an ink loader reaches a "low" volume state or an "out of ink" state. Additionally, these control systems are generally not able to determine which of the colors caused the "low" or "out of ink" state or the fill status of the other colors of solid ink that have not caused the "low" or "out of ink" state.

Moreover, prior art control systems are limited in their ability to gain specific information about an ink stick that is currently loaded in the feed channels. For instance, control systems are not able to determine if the correct color of ink stick is loaded in a particular feed channel or if the ink that is loaded is compatible with that particular printer. Provisions have been made to ensure that an ink stick is correctly loaded into the intended feed channel and to ensure that the ink stick is compatible with that printer. However, these provisions are generally directed toward excluding wrong colored or incompatible ink sticks from being inserted into the feed channels of the printer. For example, the correct loading of ink sticks has been accomplished by incorporating keying, alignment and orientation features into the exterior surface of an ink stick. These features are protuberances or indentations that are located in different positions on an ink stick. Corresponding keys or guide elements on the perimeters of the openings through which the ink sticks are inserted or fed exclude ink sticks which do not have the appropriate perimeter key elements while ensuring that the ink stick is properly aligned and oriented in the feed channel.

While this method is effective in ensuring correct loading of ink sticks in most situations, there are still situations when an ink stick may be incorrectly loaded into a feed channel of a printer. For example, due to the soft, waxy nature of an ink stick body, an ink stick may be "forced" through an opening into a feed channel. The printer control system, having no knowledge of the particular configuration of the ink stick, may then conduct normal printing operations with an incorrectly loaded ink stick. If the loaded ink stick is the wrong color for a particular feed channel or if the ink stick is incompatible with the phase change ink jet printer in which it is being used, considerable errors and malfunctions may occur.

SUMMARY

An ink stick for use in a phase change ink printer is provided, the phase change ink printer having an ink stick feed system comprising at least one ink stick feed channel for receiving the ink stick and for moving the ink stick through the ink stick feed channel. The ink stick comprises a three dimensional ink stick body configured to fit within a feed channel of a phase change ink printer. The ink stick has an exterior surface with an interface element formed therein. The interface element interfaces with an appropriately equipped ink loader to provide a reference signal to a printer control system. The controller receives the reference signal and then may translate the reference signal into control information pertaining to the ink stick.

In one embodiment, the control information comprises ink consumption information. In this embodiment, the interface element conveys, to the control system of a printer, information such as the amount of ink that passes a sensor in the feed channel. In another embodiment, the total amount of ink remaining in a feed channel might be determined. The control information may also comprise identification/authentication information pertaining to the ink stick, such as, for example, ink stick color, printer compatibility, product type, model or series, date or location of manufacture, geographic variation, including chemical or color composition based on regulations or traditions or special market requirements, such as "sold" ink vs. page pack or North American pricing v. low cost markets or European color die loading vs. Asian color die loading, etc. The control information may also comprise printer calibration information pertaining to the ink stick, such as, for example, suitable color table, thermal settings, etc. that may be used with an ink stick. The ink consumption, identification/authentication and/or printer calibration information may be used by a control system in a suitably equipped phase change ink jet printer to control print operations. Thus, printers in place in the field could accept and properly utilize evolved ink sticks with different printer parameters at some future time without requiring modification.

In another embodiment, a method of manufacturing an ink stick is provided. The method comprises selecting an appropriate interface element to form in an ink stick, the appropriate interface element being configured to interface with a sensor system in the ink loader to convey control information to a printer control system. Once the interface element has been selected, the ink stick is then formed including the selected interface element.

In another embodiment, the selection of the interface element may comprise selecting a type of interface element to form in an ink stick. A geometric characteristic of the selected interface element may then be assigned to indicate a class of control information pertaining to the ink stick. Sizes of the assigned geometric characteristic may then be selected to indicate subclasses of the control information. A particular interface element may then be selected to be formed into the element having a geometric characteristic of a specific size, the size of the geometric characteristic corresponding to a subclass of control information pertaining to the ink stick to be formed.

In yet another embodiment, a set of ink sticks is provided for use in a solid ink feed system of a phase change ink jet printer having a plurality of feed channels. The set of ink sticks comprises a plurality of ink sticks, each of the ink sticks comprising a three dimensional ink stick body configured to fit within a feed channel of a phase change ink printer. Each ink stick body has an exterior surface and an interface element formed in the exterior surface for interfacing with a sensor system to convey ink stick color information to a printer control system. The interface element includes a geometric characteristic of a specific size, the size of the geometric characteristic corresponding to a particular color of the ink stick. A first ink stick of the plurality includes an interface element having a geometric characteristic sized to correspond to a first color of ink stick; a second ink stick of the plurality includes an interface element having a geometric characteristic sized to correspond to a second color of ink stick; a third ink stick of the plurality includes an interface element having a geometric characteristic sized to correspond to a third color of ink stick; and a fourth ink stick of the plurality includes an interface element having a geometric characteristic sized to correspond to a fourth color of ink stick. Interface elements which the sensing system can dimensionally differentiate can be of different size or shape. The geometric characteristic or feature term "size" will be commonly used where "shape" would also be a differentiating characteristic. The term shape is thus intended to be synonymous or a variant of the term size in each case. As example, a square notch of a given size could be sensed differently than a rounded off notch of the same size, accomplishing the intended geometric or dimensional sensing unique to that particular form.

The solid ink stick and methods of forming the solid ink stick, described in more detail below, enable the formation of a solid ink stick having features that may be sized to positively convey control information to a printer control system. The control information may be used by a suitably equipped phase change ink jet printer to enable, disable or optimize operations, or to influence or set operation parameters to be used with the ink stick. Other benefits and advantages of the system for forming solid ink sticks will become apparent upon reading and understanding the following drawings and specification.

BRIEF DESCRIPTION OF THE DRAWINGS

FIG. 4 is a perspective view of one embodiment of a solid ink stick.

FIG. 5 is a top view of the ink stick of FIG. 4.

FIG. 6 is a perspective view of another embodiment of a solid ink stick.

FIG. 7 is a front view of the ink stick of FIG. 6.

FIG. 8 is a perspective view of another embodiment of a solid ink stick.

FIG. 9 is a front view of the ink stick of FIG. 8.

FIG. 12 is a perspective view of another embodiment of a solid ink stick.

FIG. 13 is a top view of the ink stick of FIG. 12.

FIG. 14 is a schematic view of another sensor system for measuring a geometric characteristic of the interface element of the ink stick of FIG. 12.

FIG. 15 is a perspective view of another embodiment of a solid ink stick.

DETAILED DESCRIPTION OF THE PREFERRED EMBODIMENT

Figure 1:
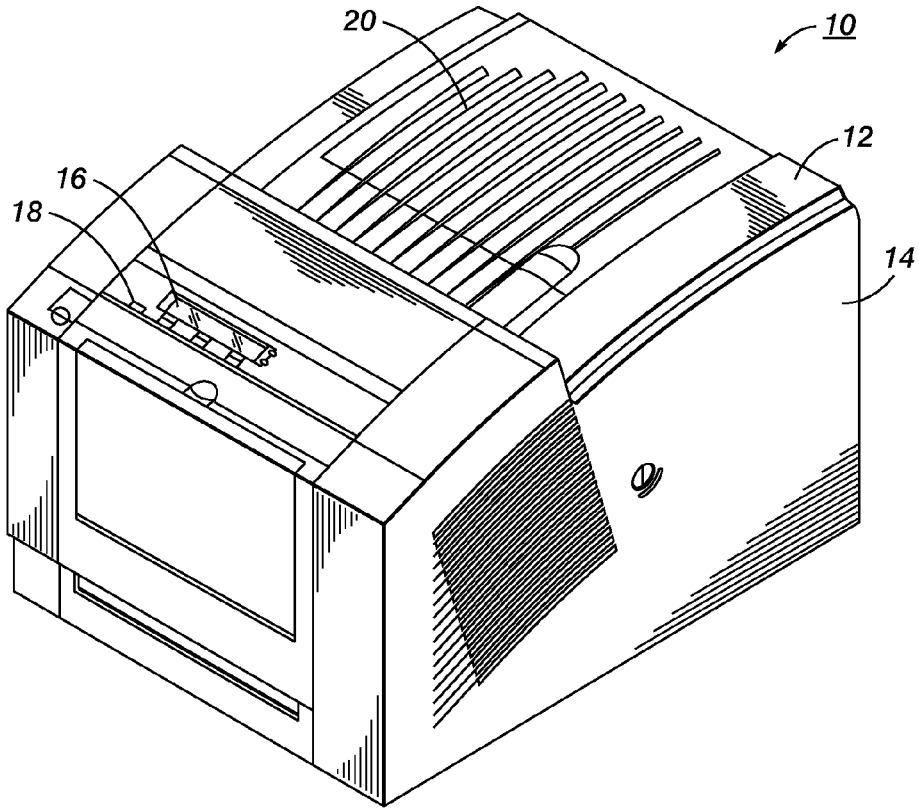
FIG. 1 is a perspective view of a phase change printer with the printer top cover closed.

For a general understanding of the present embodiments, reference is made to the drawings. In the drawings, like reference numerals have been used throughout to designate like elements.

FIG. 1 shows a solid ink, or phase change, ink printer 10 that includes an outer housing having a top surface 12 and side surfaces 14. A user interface, such as a front panel display screen 16, displays information concerning the status of the printer, and user instructions. Buttons 18 or other control elements for controlling operation of the printer are adjacent the front panel display screen, or may be at other locations on the printer. An ink jet printing mechanism (not shown) is contained inside the housing. An example of the printing mechanism is described in U.S. Pat. No. 5,805,191, entitled Surface Application System, to Jones et al., and U.S. Pat. No. 5,455,604, entitled Ink Jet Printer Architecture and Method, to Adams et al. An ink loader 100 delivers ink to the printing mechanism. The ink loader 100 is contained under the top surface of the printer housing. The top surface of the housing includes a hinged ink access cover 20 that opens as shown in FIG. 2, to provide the operator access to the ink loader 100.

Figure 2:
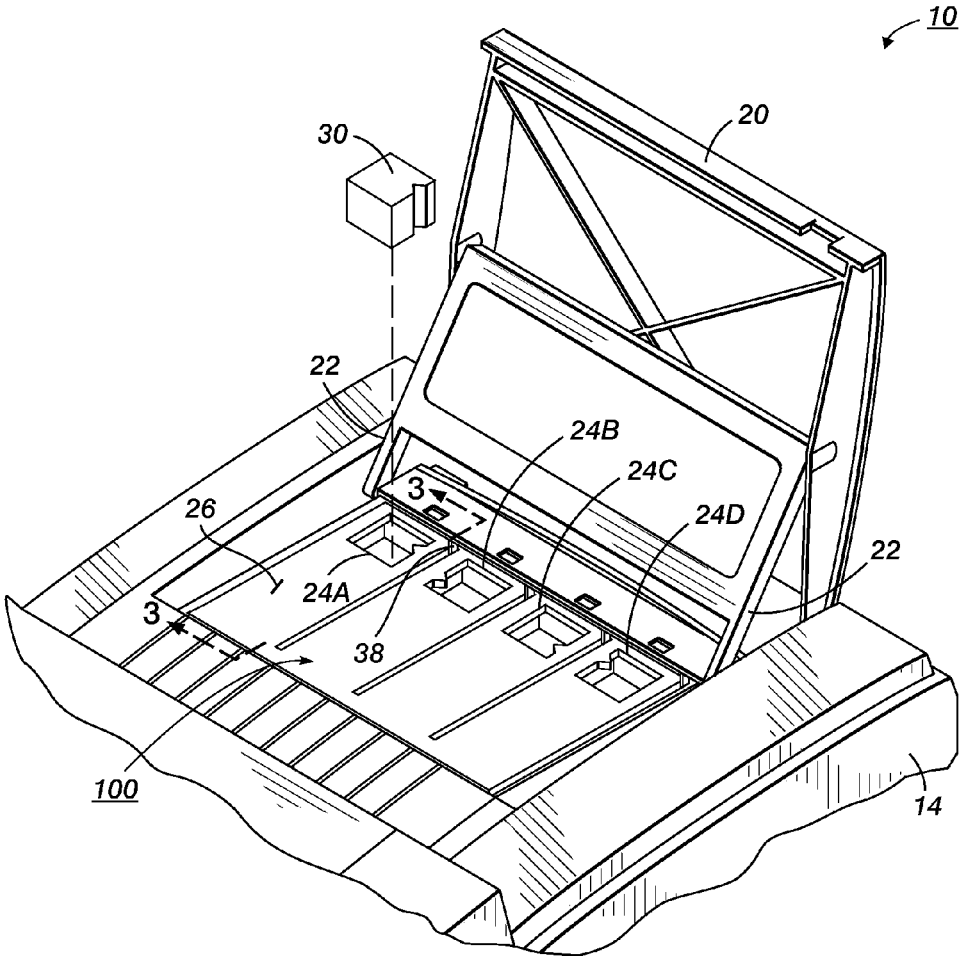
FIG. 2 is an enlarged partial top perspective view of the phase change printer with the ink access cover open, showing a solid ink stick in position to be loaded into a feed channel.
Figure 3:
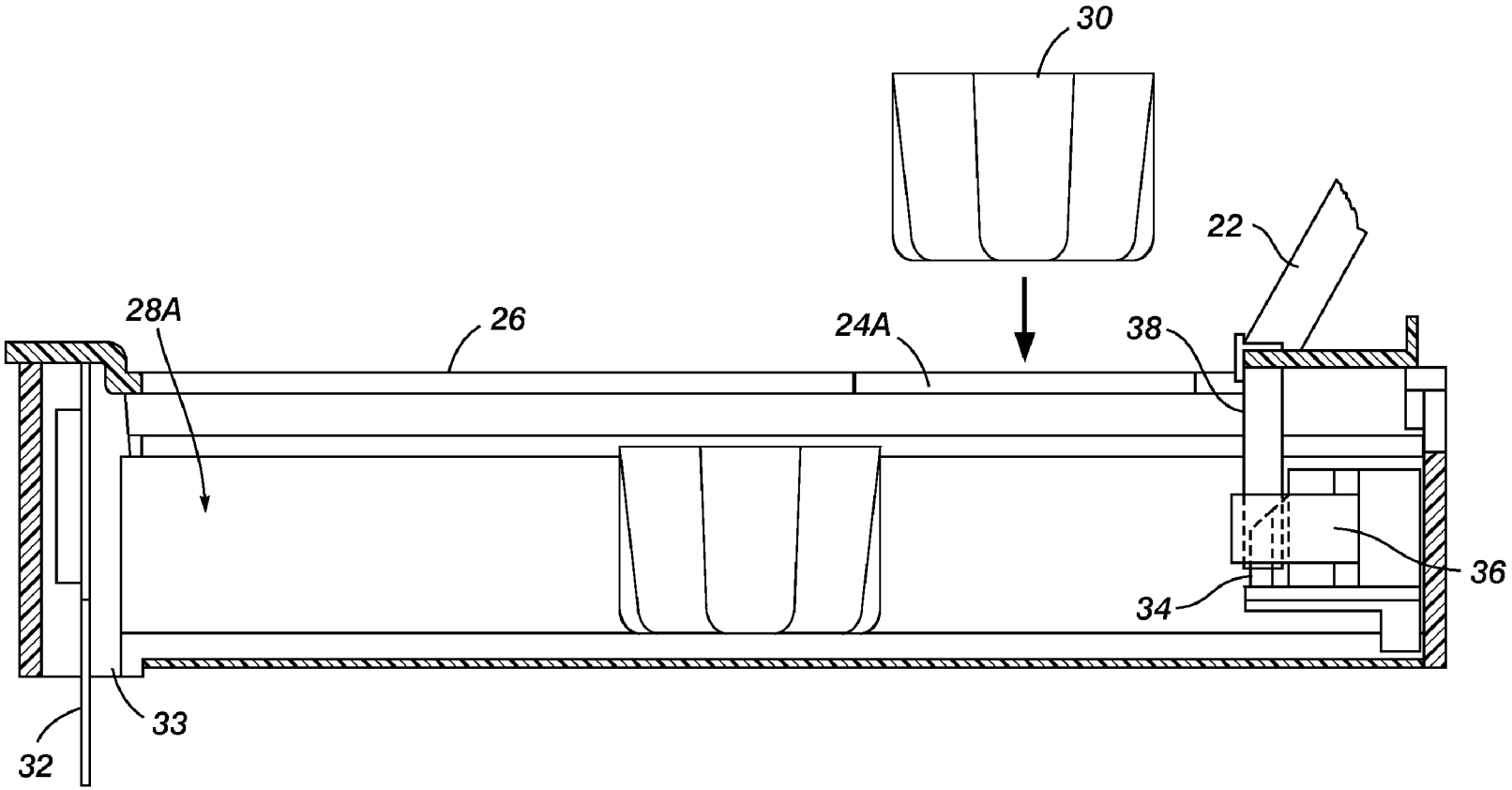
FIG. 3 is a side sectional view of a feed channel of a solid ink feed system taken along line 3-3 of FIG. 2.

FIG. 2 illustrates the printer 10 with its ink access cover 20 raised revealing an ink load linkage element 22 and an ink stick feed assembly or ink loader 100. In the particular printer shown, the ink access cover 20 is attached to an ink load linkage element 22 so that when the printer ink access cover 20 is raised, the ink load linkage 22 slides and pivots to an ink load position. The interaction of the ink access cover and the ink load linkage element is described in U.S. Pat. No. 5,861,903 for an Ink Feed System, issued Jan. 19, 1999 to Crawford et al. As seen in FIG. 2, the ink loader includes a key plate 26 having keyed openings 24. Each keyed opening 24A, 24B, 24C, 24D provides access to an insertion end of one of several individual feed channels 28A, 28B, 28C, 28D of the ink loader (see FIG. 3).

Each longitudinal feed channel 28 of the ink loader 100 delivers ink sticks 30 of one particular color to a corresponding melt plate 32. Each feed channel has a longitudinal feed direction from the insertion end of the feed channel to the melt end of the feed channel. The melt end of the feed channel is adjacent the melt plate. The melt plate melts the solid ink stick into a liquid form. The melted ink drips through a gap 33 between the melt end of the feed channel and the melt plate, and into a liquid ink reservoir (not shown). The feed channels 28A, 28B, 28C, 28D (see FIG. 3) have a longitudinal dimension from the insertion end to the melt end, and a lateral dimension, substantially perpendicular to the longitudinal dimension.

Each feed channel 28 in the particular embodiment illustrated includes a push block 34 driven by a driving force or element, such as a constant force spring 36 to push the individual ink sticks along the length of the longitudinal feed channel toward the melt plates 32 that are at the melt end of each feed channel. The tension of the constant force spring 36 drives the push block 34 toward the melt end of the feed channel. In a manner similar to that described in U.S. Pat. No. 5,861,903, the ink load linkage 22 is coupled to a yoke 38, which is attached to the constant force spring mounted in the push block. The attachment to the ink load linkage 22 pulls the push block 34 toward the insertion end of the feed channel when the ink access cover is raised to reveal the key plate 26. In the implementation illustrated, the constant force spring 36 can be a flat spring with its face oriented along a substantially vertical axis.

A color printer typically uses four colors of ink (yellow, cyan, magenta, and black). Ink sticks 30 of each color are delivered through a corresponding individual one of the feed channels 28A, 28B, 28C, 28D. The operator of the printer exercises care to avoid inserting ink sticks of one color into a feed channel for a different color. Ink sticks may be so saturated with color dye that it may be difficult for a printer operator to tell by the apparent color alone which color is which. Cyan, magenta, and black ink sticks in particular can be difficult to distinguish visually based on color appearance. The key plate 26 has keyed openings 24A, 24B, 24C, 24D to aid the printer operator in ensuring that only ink sticks of the proper color are inserted into each feed channel. Each keyed opening 24A, 24B, 24C, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

An exemplary solid ink stick 30 for use in the ink loader is illustrated in FIG. 4. The ink stick 30 is formed of a three dimensional ink stick body. The ink stick body illustrated has a bottom exemplified by a generally bottom surface 52 and a top exemplified by a generally top surface 54. The particular bottom surface 52 and top surface 54 illustrated are substantially parallel one another, although they can take on other contours and relative relationships. The surfaces of the ink stick body need not be flat, nor need they be parallel or perpendicular one another. However, these descriptions will aid the reader in visualizing, even though the surfaces may have three dimensional topography, or be angled with respect to one another. The ink stick body also has a plurality of side extremities, such as side surfaces 56 and end surfaces 61, 62. The illustrated embodiment includes four side surfaces, including two end surfaces 61, 62 and two lateral, side surfaces 56. The basic elements of the lateral side surfaces 56 are substantially parallel one another, and are substantially perpendicular to the top and bottom surfaces 52, 54. The end surfaces 61, 62 are also basically substantially parallel one another, and substantially perpendicular to the top and bottom surfaces, and to the lateral side surfaces. One of the end surfaces 61 is a leading end surface, and the other end surface 62 is a trailing end surface. The ink stick body may be formed by pour molding, injection molding, compression molding, or other known techniques.

As shown in FIGS. 4-9, the ink stick may include an interface element 70 for interfacing with an appropriately equipped ink loader 100 to provide a reference signal to a printer control system (not shown). The interface element 70 may comprise a feature formed into the exterior surface of an ink stick, such as, for example, a protrusion, step, recess or notch. The ink loader 100 may include a sensor system (explained in more detail below) designed to interface with a particular configuration of interface element 70 and to generate a reference signal that corresponds to the particular configuration. For example, in one embodiment, the reference signal corresponds to a measured value of a geometric characteristic of the interface element, such as, for example, a linear or angular dimension of the interface element. Alternatively, the reference signal may be generated by using a feature of the interface element to set or actuate one or more flags or sensors located in specified positions in the feed channel.

The reference signal may be translated by a printer control system into information that may be used in a number of ways by the control system of a printer. For example, the printer control system may compare the reference signal to data stored in a data structure, such as a table. The data stored in the data structure may comprise a plurality of possible reference signal values with associated information corresponding to each value. The associated information may comprise control information that pertains to an ink stick. For instance, in one embodiment, the control information comprises ink consumption information. In this embodiment, the interface element conveys, to the control system of a printer, information such as the amount of ink that passes a sensor in the feed channel or the total amount of ink remaining in a feed channel. The control information may also comprise identification/authentication information pertaining to the ink stick, such as, for example, ink stick color, printer compatibility, or ink stick composition information, or may comprise printer calibration information pertaining to the ink stick, such as, for example, suitable color table, thermal settings, etc. that may be used with an ink stick. The ink consumption, identification/authentication and/or printer calibration information may be used by a control system in a suitably equipped phase change ink jet printer to control print operations. For example, the control system may enable or disable operations, optimize operations or influence or set operation parameters based on the "associated information" that corresponds to the index key provided by an interface element.

As mentioned above, the reference signal may correspond to a measured value of a geometric characteristic of the interface element. The geometric characteristic may comprise a linear or angular dimension of the interface element. A linear dimension may be a height or depth of all or a portion of a recessed or protruding interface element, an inside or outside width between two surfaces of a recess or notch, the length or width of protrusion, a distance across all or a portion of an ink stick body to an edge of an interface element, etc.

FIGS. 6 and 7 show an embodiment of an ink stick having an interface element 70 with linear dimensions. The element 70 may comprise a step having a first linear attribute H and a second linear attribute W. In this embodiment, the step traverses the length of the ink stick parallel to arrow F (feed direction). The first linear attribute H of the step comprises a linear dimension corresponding to the depth, or height, of the step in a vertical direction from the bottom surface 74 of the step to the top surface 54 of the ink stick. The second linear attribute W of the step comprises a linear dimension corresponding to the depth, or width, of the step in a horizontal direction from the side surface 78 of the step to the lateral side surface 56 of the ink stick.

Referring now to FIGS. 4 and 5, the linear dimension may be a distance across all or a portion of an ink stick body to an edge or surface of an interface element. For example, as shown in FIGS. 4 and 5, attribute W corresponds to a distance from a rear surface or end of an ink stick to the rear edge of the interface element 70. Attribute X corresponds to a distance from the rear surface to an opposite edge of the interface element. Attributes Y and Z are similar to attributes W and X except the distances start from the front surface or end of the ink stick.

An angular dimension of an interface element may comprise the angle formed by a surface of the element 70 relative to a reference element, such as, for example, another surface of the interface element 70, another surface of the ink stick body, or a surface of the feed channel. For example, referring to FIGS. 4 and 5, the interface element 70 may comprise a notch formed in one of the lateral side surfaces 56 of the ink stick body. In this case, the notch extends from the top surface 54 to the bottom surface 52 of the ink stick substantially perpendicular to feed direction F. The notch 70 includes an angular dimension A that corresponds to the angle formed by the surface 90 of the notch 70 relative to lateral surface 56 of the ink stick body.

Control information may be encoded into the interface element of an ink stick by sizing the geometric characteristic of the interface element to correspond to the control information for that ink stick during manufacturing. For example, a geometric characteristic of an interface element may be preselected, or assigned, to correspond to a class of control information pertaining to the ink stick, such as, for example, ink consumption, ink stick color, printer compatibility, etc. Specific values or ranges of values that correspond to that geometric characteristic of the interface element may then be assigned to indicate a particular item, or subclass, of control information. For example, the colors cyan may be a subclass of the class color. Ink sticks may then be manufactured including an interface element with the geometric characteristic of an assigned size or sized within the assigned ranges to indicate the particular subclass of information pertaining to the ink stick.

As an example, the interface element 70 in FIGS. 8 and 9 comprises a recess. The depth D of the recess may be assigned to indicate the color of an ink stick. Possible depths or ranges of possible depths of the recess may then be assigned to indicate each color. For example, a depth of 1 mm to 2 mm may be assigned to indicate a cyan ink stick; a depth of 2 mm to 3 mm may be assigned to indicate a black ink stick; etc. Thus, a cyan ink stick may be manufactured including a recess having a depth of between 1 mm and 2 mm. A data structure, such as a table, may be created that contains the assigned ranges of values and the colors or other control information to be associated with each value in the table. The data structure may be stored in memory in the printer to be accessed by the printer control system.

The ink loader may include a sensor system for measuring or detecting the linear and/or angular dimensions of an interface element. The exact configuration of the interface element and ink loader sensor system for generating the reference signal may depend on the type of information to be conveyed by the reference signal. The sensor system may be configured to optically or mechanically measure a geometric characteristic of an interface element.

Figure 10:
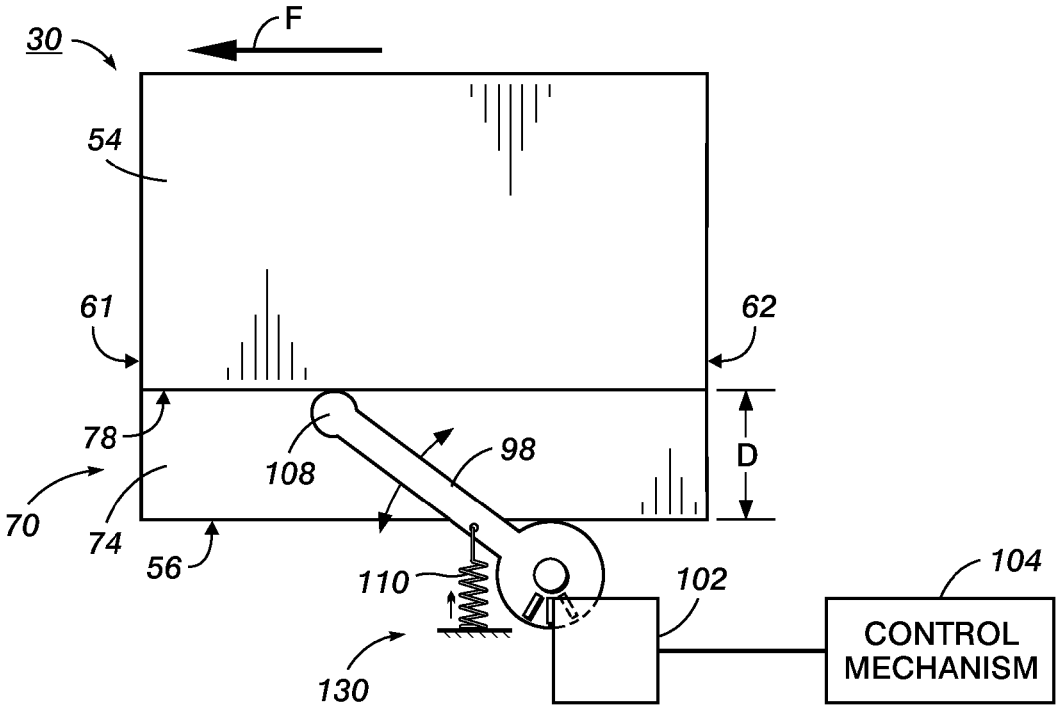
FIG. 10 is a schematic view of a sensor system for measuring a geometric characteristic of an interface element of an ink stick.

Referring to FIG. 10, there is shown an example of a sensor system 130 that may be incorporated into an ink loader for mechanically measuring a geometric characteristic of an interface element while the ink stick is in the feed channel. In the embodiment shown, the interface element 70 of the ink stick 30 comprises a recessed step. The sensor system measures a linear dimension of the step, in this case, the depth D of the step 70 from the lateral surface 56 of the ink stick to the side surface 78 of the step 70.

In one embodiment, the sensor system 130 may include an arm 98, a sensor 102, and controller 104. The arm 98 may be rotatably supported on a lateral wall of the feed channel (not shown) and configured to rotate about an axis in an imaginary plane that may be parallel to the bottom surface (not shown) of the feed channel. The arm 98 may be positioned vertically on the wall of the feed channel in a position to engage the side surface 78 of the step as the ink stick 30 is being fed along the feed channel in the feed direction F. The arm 98 includes a contact portion 108 on a radial end for contacting the side surface 78 of the step 70. The arm 98 is biased into the feed channel by biasing spring 110. The spring 110 is configured to apply enough force to bring the contact surface 108 of the arm 98 into contact with the side surface 78 of the step 70 without dislodging the ink stick 30 within the feed channel or causing the ink stick to skew as it is being fed along the feed channel. The described configuration could as easily be placed on a different surface of the channel and ink stick. Gravity could be employed in place of the biasing spring by appropriate arm mass configuration and orientation.

The sensor 102 comprises a device capable of measuring the angle of rotation of arm 98 in the imaginary plane, such as an optical sensor, encoder, strain gauge, a rotary variable differential transformer (RVDT) or other sensing means. The angular displacement of the arm corresponds to the depth D of the recess. As an ink stick 30 is being fed along the feed channel, the contact surface 108 of the arm 98 is laterally biased into contact with the side surface 78 of the step 70. The angle of movement of arm 98 is read by sensor 102 and a reference signal is generated that corresponds to the measured value.

Figure 11:
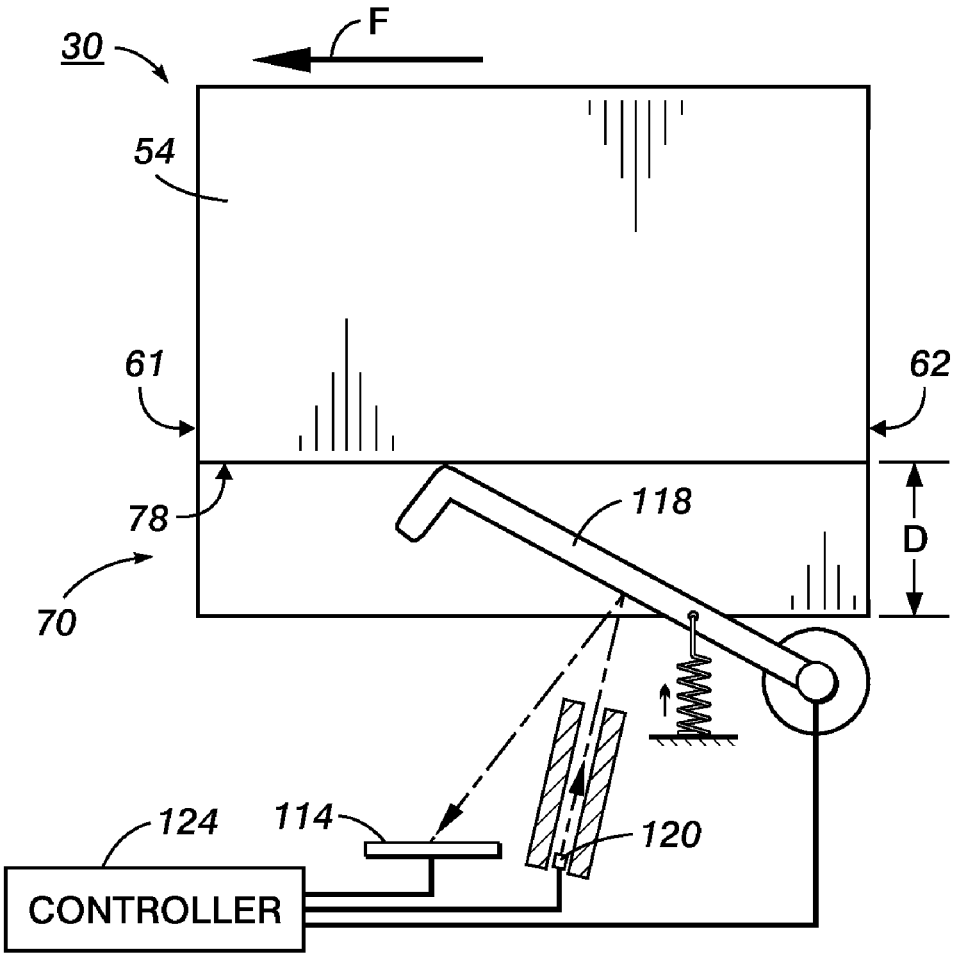
FIG. 11 is a schematic view of another sensor system for measuring a geometric characteristic of an interface element of an ink stick.

FIG. 11 shows an embodiment of a sensor system 100 for optically measuring a geometric characteristic of an interface element 70. In this embodiment, the sensor comprises a photodetector array or position sensor 114. A laser transmitter 120 placed in the feed channel projects a laser onto an arm 118 as it engages an ink stick 30. The sensor 114 is positioned in the feed channel at a location to detect the angle of deflection of the laser beam as it is reflected back from the arm 118. A reference signal may then be generated that corresponds to the angle of deflection. A reflective material or coating may be added to the arm for this purpose or the arm may be comprised of a material and color that provides the necessary reflective property for the wave length in use.

The controller receives a reference signal and then translates the reference signal into the appropriate control information pertaining to the ink stick. For example, a depth of a recess may be assigned to indicate color of ink stick with specific depths or ranges of depths assigned to indicate particular colors of ink stick. A reference signal that corresponds to the measured depth of the recess may be compared to a data structure containing possible depth values with a color of ink stick that corresponds to each value. If the sensor system is located in the feed channel for black ink and the controller determines from the reference signal received that the current ink stick is a cyan ink stick, the controller may disable print operations and/or display a message on the display screen indicating that a wrong-colored ink stick has been inserted in the feed channel for black ink.

FIGS. 12 and 13 show an embodiment of an ink stick having an interface element designed to generate a reference signal that corresponds to ink consumption information. In the embodiment shown, the interface element 70 comprises an angled recess that traverses the top surface 54 of the ink stick 30 from the trailing end 62 to leading end 61 of the ink stick 30 as shown in FIGS. 12 and 13.

As shown in FIG. 14, the ink loader includes a sensor system 130 for measuring the depth D of the recess as the push block 34 urges the ink stick 30 in the feed direction F. In this embodiment, the sensor system comprises an arm 98 for contacting the surface of the recess and a sensor 102 for measuring the angular displacement of the arm. The arm 98 may be rotatably supported on a wall of the feed channel or an extended pivot structure. The arm 98 is positioned to contact the surface of the recess along the entire length of the recess as the ink stick passes the arm in the feed channel. As the push block 34 urges the ink stick 30 toward the melt plate the depth D of the recess decreases, thus causing the angular displacement of the arm 98 to decrease. The sensor 130 comprises a device capable of measuring the angle of rotation of arm 98, such as an encoder or a rotary variable differential transformer (RVDT). The sensor 102 generates a reference signal that corresponds to the angular displacement of the arm. Signal change could be in increments or continuous. Thus, the reference signal generated corresponds substantially to the depth D of the recess as the ink stick 30 is consumed. A printer control system may then be able to determine, based on the reference signal generated, the approximate amount of ink that has been consumed (or that remains) from an individual ink stick. Thus, rather than recording ink consumption in terms of whole ink sticks, the angled interface element 70 enables fractions of a stick to be detectable. An angular element could also be used to differentiate an ink stick characteristic from a different ink stick with a different characteristic where that stick has a different angle or no angle. The above described sensing functions use an arm or intermediate interface of some type but the concept is intended to encompass direct reflecting configurations as well. Optical sensors could detect reflection changes from the ink surface or surfaces. All techniques are intended to encompass one or more sensing surface or surface variations that can be created in an ink stick, as example, chamfered corners.

FIG. 15. shows another embodiment of an ink stick having an interface element designed to generate a reference signal that corresponds to ink consumption information. In this embodiment, the interface element 70 comprises a plurality of spaced features, in this case bevels, formed in a lateral side of the ink stick body from leading end to trailing end. Spacing may be variable to accommodate changes in mass along a shaped ink stick. Additionally, ink with asymmetrical front to back shapes, for example, a stick with significant taper at the leading or trailing end of the stick, may have such features placed along only a portion of the length from front to back for the same reason. The individual bevels may be detected by a sensor system in the ink loader (not shown). The bevels may be detected optically, although any suitable detection method may be used. The sensor system generates a reference signal in response to the detection of a bevel as it passes the sensor. The spaced positioning of the bevels or alternate features along the side of the ink stick enables a determination of the approximate amount of an ink stick that has been consumed between any two or more features. For instance, in the case of an interface element comprising ten evenly spaced bevels, as shown in FIG. 15, the control system may be programmed with data that one tenth of an ink stick has been consumed with each generation of the reference signal.

A benefit of using an interface element 70 to determine ink stick consumption is optimization of print head functioning. As described above, once ink has been melted and reaches the print head of a printer, the liquid ink flows through manifolds to be ejected from microscopic orifices through use of piezoelectric transducer (PZT) print head technology. An electric pulse is applied to the PZT thereby causing droplets of ink to be ejected from the orifices. The duration and amplitude of the electrical pulse applied to the PZT is controlled so that a consistent volume of ink may be ejected by each orifice. Thus, the total amount of ink that has been "theoretically" used may be calculated by counting the number of times ink has been ejected from the PZT and multiplying that by the amount of ink that should have been ejected during each pulse. The amount of ink ejected from the PZT may vary or drift over time due to a number of factors, such as, for example, prolonged use. By comparing the rate of ink mass passing the sensor to theoretical ink mass consumed during imaging, the amount of drift of the quantity ink ejected from the PZT may be determined. The amplitude or duration of the electric pulse may then be calibrated to correct the drift so that the amount of ink ejected by the PZT may be optimized.

Figure 16:
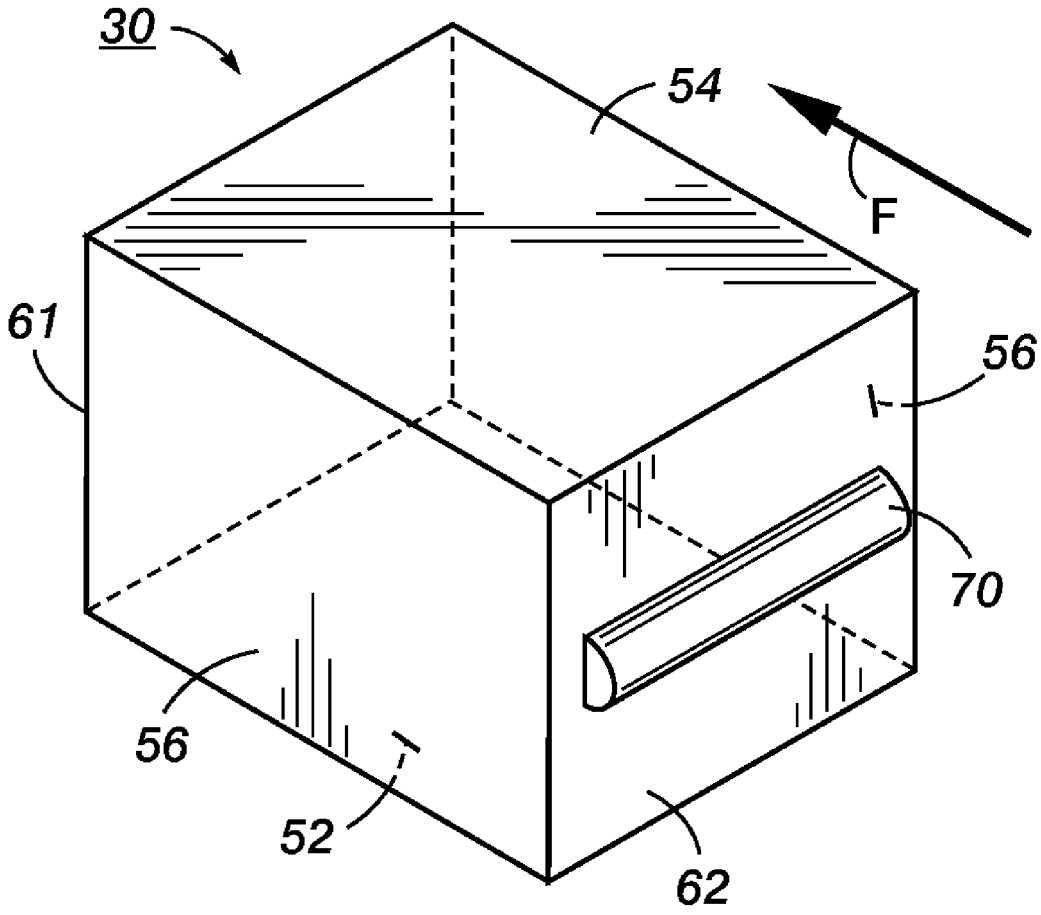
FIG. 16 is a perspective view of another embodiment of a solid ink stick.

FIG. 16 shows an embodiment of an ink stick having an interface element 70 designed to interface with an ink loader 100 to provide a reference signal corresponding to the total amount of ink remaining in a feed channel. In particular, the interface element 70 shown comprises a protrusion formed on the trailing end 62 of the ink stick. The protrusion extends horizontally along a central portion of the trailing end 62 of the ink stick. The protrusion 70 interfaces with a push block assembly of an ink level sensing system in a feed channel of the ink loader to provide the reference signal (described in more detail below).

Figure 17:
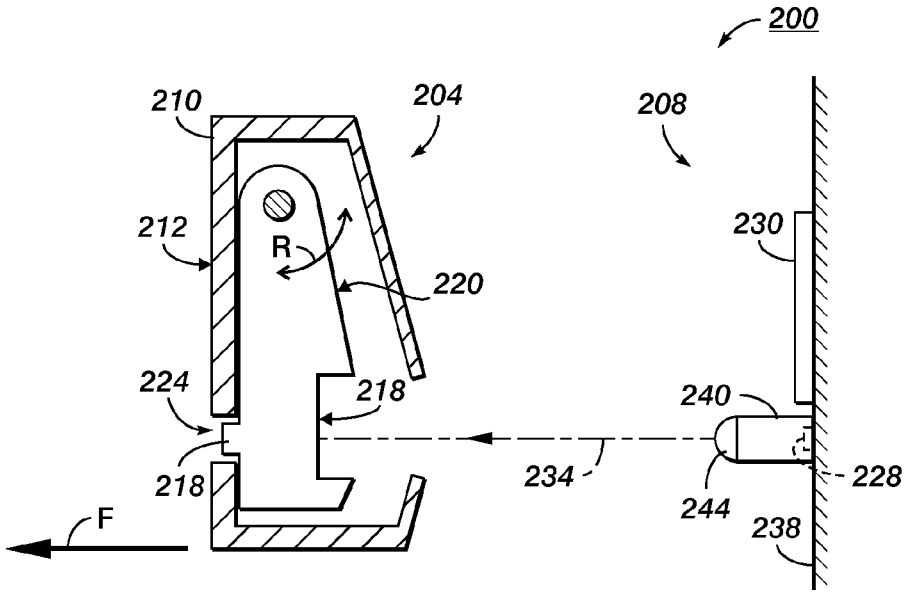
FIG. 17 is a side schematic view of an embodiment of an ink level sensing system.
Figure 18:
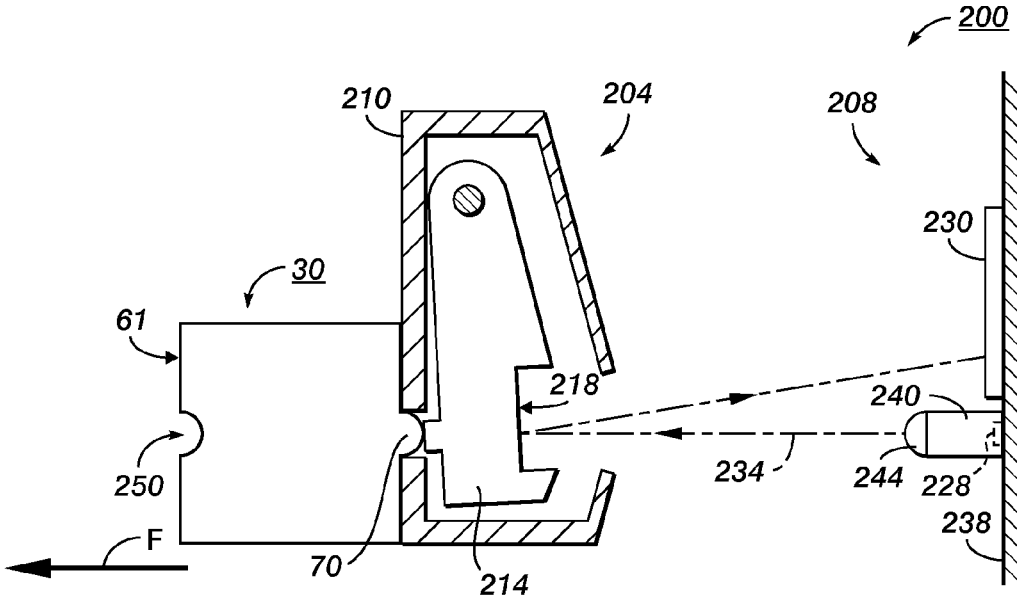
FIG. 18 is a side schematic view of an embodiment of an ink level sensing system in use.

Referring to FIG. 17, an ink level sensing system 200 includes a specially designed push block assembly 204 and sensor system 208 located in a feed channel to generate the reference signal. The push block assembly 204 interfaces with the interface element 70 of the ink stick of FIG. 16. The push block assembly 204 comprises a housing 210 including a front surface 212 for engaging the rear surface of an ink stick and urging the ink stick along the feed channel in the feed direction F. An arm 214 is pivotally mounted relative to the housing 210 such that a front surface of the arm is adjacent the interior portion of the front surface 212 of the push block housing 210. The arm 214 is rotatable in a direction R that corresponds to a horizontal plane that is parallel to the feed direction F. The arm 214 includes a reflective surface 218 on a rear portion 220 thereof for reflecting incident light beams. The front surface 212 of the push block housing 210 includes an opening 224 that provides access to the front surface of the pivoting arm 214 inside the housing. As shown in FIG. 18, the opening 224 in the front surface of the push block housing is sized to allow an appropriately sized interface element to interface with the arm causing the arm to pivot thereby changing the angle at which the reflective surface of the arm is oriented.

The sensor system 208 comprises a light emitter 228 and a position detector 230. The emitter 228 and the detector 230 are placed in the feed channel so that a collimated beam 234 emitted from the emitter 228 may be reflected by the reflective surface 218 of the pivoting arm 214 and made incident upon the detector 230. In the embodiment shown, the emitter 228 and detector 230 are mounted adjacently to a rear wall 238 of the feed channel. These components could alternatively be mounted to the push block. The emitter 228 may be composed of a laser diode 240 and a collimating lens 244 which collimates the laser beam 234 emitted from the laser diode 240 toward the reflective surface 218 of the arm in the push block housing. The position detector 230 may be composed of a condenser lens (not shown) which condenses the laser beams 234 reflected by the reflective surface 218 and a PSD (Position Sensing Device) which receives the reflected light. The PSD is a device that works like a variable resistor whose resistance changes with the position at which the device is struck by light. A reference signal may be generated by the sensor system 200 that corresponds to this resistance value.

The opening 224 in the front surface of the push block housing may have any suitable shape and may be located in any suitable position on the front surface of the push block housing. An ink stick of the proper configuration for a particular feed channel, i.e. of the proper color, may be formed with an interface element 70 that is complementary to protruding into the shape of the opening in the front surface of the housing. The shape and/or the position of the opening may exclude ink sticks having an inappropriately shaped or positioned interface element from interfacing with the sensor system of the ink loader. Initially, the angle at which the reflective surface of the arm is oriented before interfacing with an appropriate interface element of an ink stick may be such that light beams emitted by the emitter are not reflected back to the detector as shown in FIG. 17. Once an ink stick having an appropriate interface element is inserted into a feed channel and the interface element has interfaced with the push block, the reflective surface of the arm may be pivoted to an appropriate position for reflecting light beams onto the detector. (See FIG. 18). Thus, when an ink stick of an inappropriate configuration, i.e. having an inappropriate interface element, is inserted into a feed channel, the arm may not be pivoted to a position to reflect light beams onto the detector.

Figure 19:
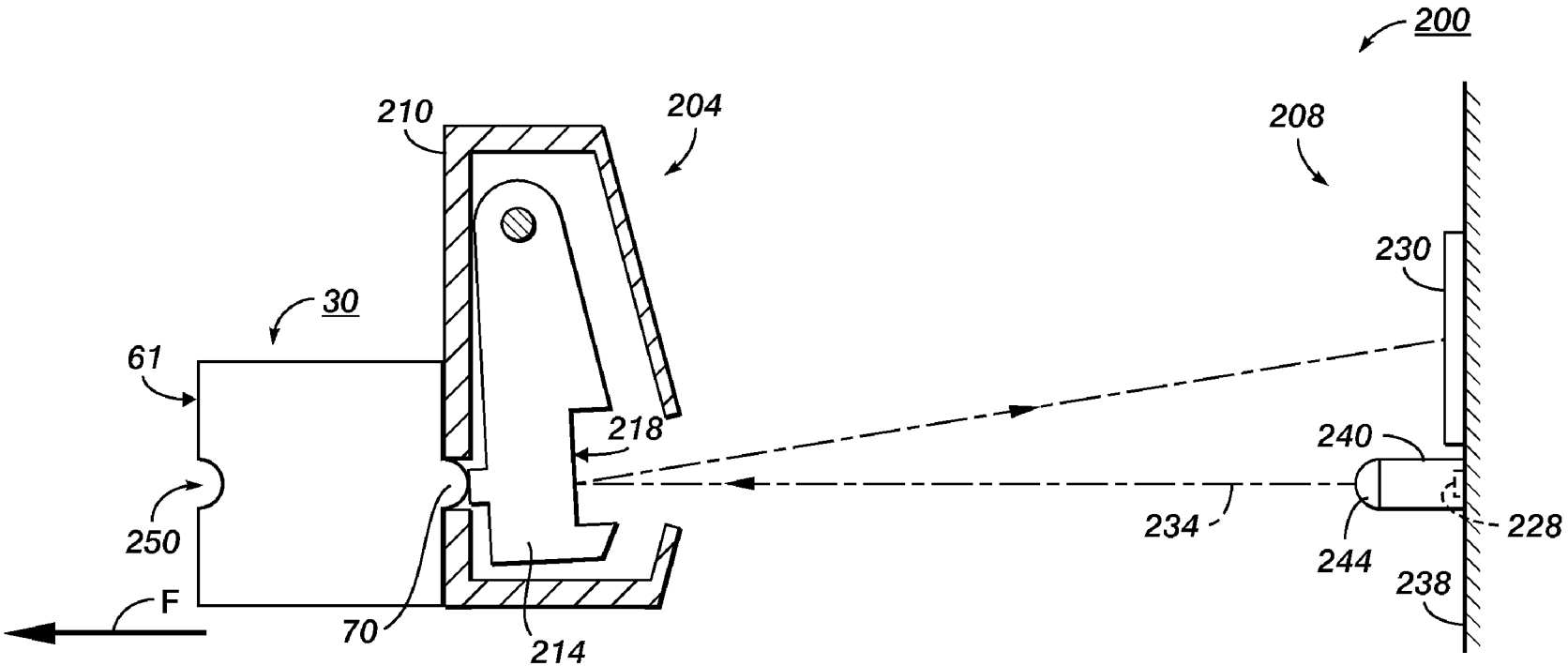
FIG. 19 is another side schematic view of an embodiment of an ink level sensing system in use.

In use, when an ink stick 30 having an appropriate interface element 70 has been inserted into a feed channel and has interfaced with the push block assembly of the ink loader (as shown in FIGS. 18 and 19), the reflective surface 218 of the arm 214 is pivoted into a position to reflect light beams from the emitter 234 onto the detector 230. The angle of reflectance of the reflected light beams is known and does not change so long as the interface element 70 of the ink stick is interfaced with the push block assembly 204.

As shown in FIG. 19, as the push block assembly 204 urges the ink stick 30 along the feed channel, the position at which the light beam is reflected onto the PSD 230 changes. The change in the position at which the light beam is reflected corresponds to the distance the push block has traveled along the feed channel. As mentioned above, the resistance of the PSD changes with the position at which the device is struck by light. A reference signal may be generated by the sensor system that is based on the resistance of the PSD 230. Thus, a printer control system may be able to determine the distance the push block 204 has traveled along the feed channel based on the reference signal. The distance or position of the push block in the feed channel corresponds to the amount of ink, or the number of ink sticks that are loaded in a feed channel. Thus, by determining the position of the push block, a printer control system may be able to determine the amount of ink, or ink level, in a particular feed channel.

In another embodiment, ranges of possible resistance values of the PSD may be assigned to indicate different levels of ink remaining in a feed channel. For instance, a first range of resistance values may be assigned to indicate that the feed channel is "low" or less than half full, and a second range of resistance values may be assigned to indicate that the feed channel is "out" or almost out of ink. While the PSD type sensor provides an ideal reference for function, the sensing could as easily be accomplished by other types of sensors. As example, an array of detectors could be used and the varying output of each as the beam moves along would provide the means to correlate distance to the push block.

As shown in FIGS. 18 and 19, an ink stick having a protruding interface element in the rear surface 62 of the ink stick 30 may have a complementary inset or indentation 250 on the leading end 61. The protruding elements 70 on the trailing end 62 of one ink stick are capable of nesting into the recessed elements 250 of the leading end 61 of an adjacent ink stick when the ink sticks abut one another.

Figures 20, 21:
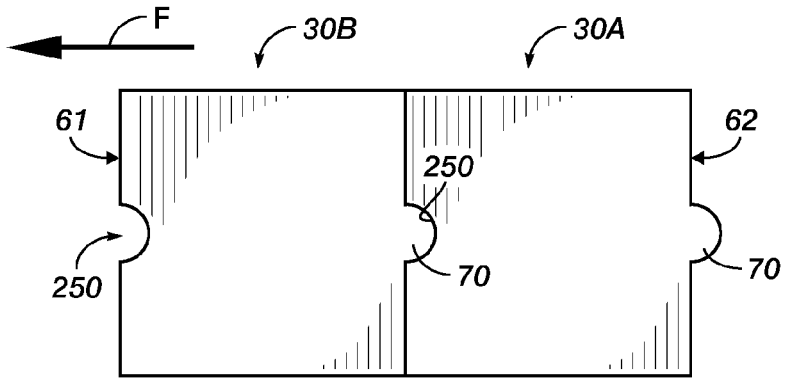
FIG. 20 is a side view of nested ink sticks.
FIG. 21 is an example attribute array of information that may be provided by an ink stick.

Referring now to FIG. 20, two adjacent ink sticks are shown. The recessed elements 250 of the leading end 61 of a first ink stick 30A nest with the protruding elements 70 on the trailing end of the second ink stick 30B. An advantage of "nesting" ink sticks is that movement of the ink sticks is limited relative to one another. By limiting movement of the ink sticks with respect to one another, the ink sticks do not become skewed with respect to each other, or with respect to the feed channel, as the ink sticks travel along the length of the feed channel of the solid ink feed system. With the ink stick properly aligned within the feed channel, the ink stick meets the melt plate normal to the melt plate surface. Proper alignment between the ink stick and the melt plate enhances even melting of the ink stick. Even melting reduces the formation of unmelted corner slivers at the trailing end of each ink stick. Such unmelted corner slivers may slip through the gap between the melt plate and the end of the feed channel, potentially interfering with the proper functioning of certain portions of the printer.

Each feed channel of an ink loader may include a sensing system described above. This allows the printer control system to determine which color of ink is "low" or which color is deemed to be "out." Furthermore, the ability to determine the ink level in each feed channel allows the volume status of all the different color inks to be known at all times.

Any suitable means of determining push block position in the feed channel is contemplated. For instance, the detector may determine position of the push block based on signal strength of the reflected light beam. Other types of position detectors for detecting the angle of reflectance of a reflected light beam may be used such as a photodetector array. Power to the emitters and detectors does not have to be constant. They may be intermittently checked based on printer usage or by request from a user interface.

An interface element may be used in combination with keying, orientation and alignment features. This combination of features provides multiple mechanisms for ensuring proper loading of ink sticks and for providing control information pertaining to an ink stick to a printer control system. In one embodiment, multiple interface elements or geometric characteristics of an interface element may be used simultaneously. For example, the depth of a recess may be selected to indicate ink stick color, the inside width of the recess may be selected to indicate printer series, and an angle of a surface of the recess may be selected to indicate to the printer the optimum operating parameters for the ink stick. Thus, an array of control information may be established for each feed channel with a sensor or detector for each interface element or characteristic with the interface elements providing the inputs to the array. Thus, by using multiple sensors for multiple interface elements in a feed channel, a matrix of information may be provided by an ink stick to the printer control system (see FIG. 21).

Figure 22:
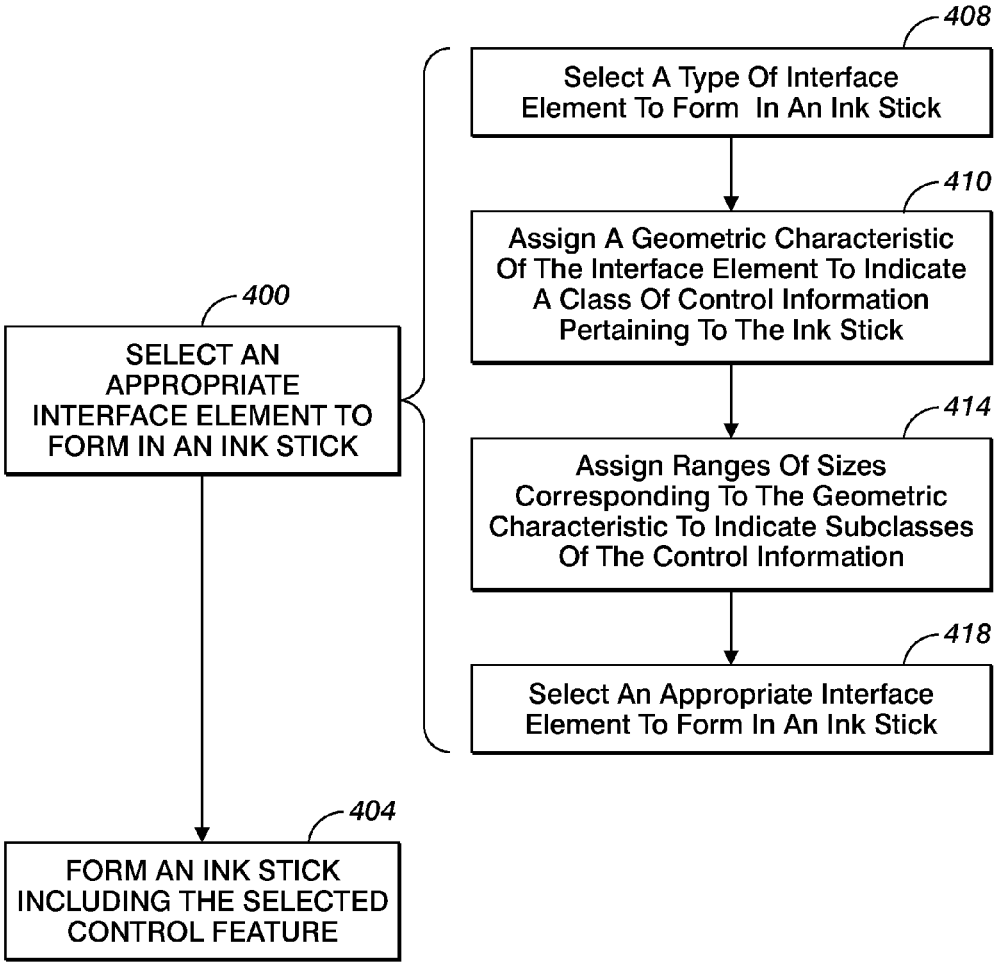
FIG. 22 is a flowchart for a method of manufacturing solid ink sticks.

FIG. 22 is a flowchart outlining an exemplary embodiment of a method of manufacturing a solid ink with an interface element. The method comprises selecting an appropriate interface element to form in an ink stick, the appropriate interface element being configured to interface with a sensor system in the ink loader to convey control information to a printer control system (block 400). Once the interface element has been selected, the ink stick is then formed including the selected interface element (block 404).

In another embodiment, the selection of the interface element may comprise selecting a type of interface element to form in an ink stick (block 408). A geometric characteristic of the selected interface element may then be assigned to indicate a class of control information pertaining to the ink stick (block 410). Sizes of the assigned geometric characteristic may then be selected to indicate subclasses of the control information (block 414). A particular interface element may then be selected to form in the ink stick having a geometric characteristic of a specific size, the size of the geometric characteristic corresponding to a subclass of control information pertaining to the ink stick to be formed (block 418).

The type of interface element selected may include a recess. The depth of the recess may then be assigned to indicate the class of control information pertaining to the ink stick. Alternatively, the interface element may include an angle formed by a surface of the interface element relative to another surface. The angle of the interface element may then be assigned to indicate the class of control information pertaining to the ink stick.

Those skilled in the art will recognize that numerous modifications can be made to the specific implementations described above. Those skilled in the art will recognize that the interface element may be formed into numerous shapes and configurations other than those illustrated. In addition, numerous other attributes of interface elements and classes of control information are contemplated within the scope of this disclosure. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An ink stick for use in an ink loader of an imaging device, the ink stick comprising:

a three dimensional ink stick body configured to fit within the ink loader of the imaging device, the ink stick body having an exterior surface; and an interface element formed in the exterior surface of the ink stick body, the interface element being configured with a protrusion having a predetermined height that corresponds to a control parameter, the protrusion being configured to enable a sensor in the ink loader of the imaging device to detect the predetermined height of the protrusion.

2. The ink stick of claim 1, wherein the predetermined height of the protrusion detected by the sensor is converted to a reference signal corresponding to the control parameter.

3. The ink stick of claim 1, wherein the predetermined height of the protrusion corresponds to a control parameter that identifies the ink stick.

4. The ink stick of claim 1, wherein the predetermined height of the protrusion corresponds to a control parameter that identifies a color of the ink stick.

5. The ink stick of claim 1, wherein the predetermined height of the protrusion corresponds to a control parameter that identifies imaging device calibration information pertaining to the ink stick.

6. A set of ink sticks for use in an ink loader of an imaging device, the set of ink sticks comprising:

a plurality of ink sticks, each ink stick of the plurality of ink sticks comprising:

a three dimensional ink stick body configured to fit within the ink loader of an imaging device, the ink stick body having an exterior surface; and an interface element formed in the exterior surface of the ink stick body, the interface element being configured with a protrusion having a predetermined height, the protrusion being configured to enable a sensor in an ink loader of an imaging device to detect the predetermined height of the protrusion, the protrusion of each interface element of the ink sticks in the plurality of ink sticks enabling a control system in the imaging device to identify a control parameter for each ink stick in the plurality of ink sticks.

7. The set of ink sticks of claim 6, wherein the protrusion of the interface element for a first ink stick of the plurality of ink sticks has a first predetermined height that corresponds to a first color of ink stick;

wherein the protrusion of the interface element for a second ink stick of the plurality of ink sticks has a second predetermined height that corresponds to a second color of ink stick;

wherein the protrusion of the interface element for a third ink stick of the plurality of ink sticks has a third predetermined height that corresponds to a third color of ink stick; and wherein the protrusion of the interface element for a fourth ink stick of the plurality of ink sticks has a fourth predetermined height that corresponds to a fourth color of ink stick.

8. The set of ink sticks of claim 6, wherein each predetermined height for the protrusions of the interface elements identifies an ink stick composition for each ink stick in the plurality of ink sticks.

9. The set of ink sticks of claim 6, wherein each predetermined height for the protrusions of the interface elements identifies a manufacturing location for each ink stick in the plurality of ink sticks.

10. The set of ink sticks of claim 6, wherein each predetermined height for the protrusions of the interface elements identifies a marketing requirement for each ink stick in the plurality of ink sticks.

* * * * *